US005469873A

United States Patent [19]

Guth

[11] Patent Number: 5,469,873

[45] Date of Patent: Nov. 28, 1995

[54] DEVICE FOR PRODUCING STREAKS IN HAIR

[76] Inventor: Rouven Guth, Moorhof 6, D-31816 Liebenau, Germany

[21] Appl. No.: 213,020

[22] Filed: Mar. 15, 1994

[30] Foreign Application Priority Data

Mar. 18, 1993 [DE] Germany ..... 93 04 005.9
Oct. 23, 1993 [DE] Germany ..... 43 36 186.2

[51] Int. Cl.[6] ..... A45D 19/18; A45D 40/30

[52] U.S. Cl. ..... 132/270; 132/319

[58] Field of Search ..... 132/208, 270, 132/902, 319

[56] References Cited

U.S. PATENT DOCUMENTS

| | | | |
|---|---|---|---|
| 3,599,647 | 8/1971 | Fabbti | 132/270 |
| 3,921,647 | 11/1975 | Fisher | 132/270 |
| 4,144,897 | 3/1979 | Mosz | 132/270 |
| 4,942,893 | 7/1990 | Trottier | 132/270 |
| 5,007,443 | 4/1991 | Fulgoni | 132/270 |
| 5,056,539 | 10/1991 | Abramson | 132/270 |
| 5,349,970 | 9/1994 | Razzouq | 132/208 |

FOREIGN PATENT DOCUMENTS 2480096 10/1981 France .

9210631 12/1992 Germany .

*Primary Examiner*—John G. Weiss
*Assistant Examiner*—Elise P. Speaks
*Attorney, Agent, or Firm*—Shlesinger Arkwright & Garvey

[57] ABSTRACT

A device 2, 102 for streaking hair by use of a streaking dye includes a base plate 4, 104 which can be placed against a person's head to serve as a support for a hair-"passee" 24 to be treated. The device 2, 102 further includes a perforation-pattern plate 10, 106 which can be laid on the base plate 4, 104 and thereby on the hair-"passee" 24. Perforation-pattern plate 10, 106 has a finished pattern of arbitrary geometry and on which the streaking dye can be deposited. The base plate 4, 104 and the perforation-pattern plate 10, 106 are approximately rectangular, each comprising a respective concave side 12, 120 and 14, 124 configured to be placed against the head. The base plate 104 and the perforation-pattern designed as an intermediate plate 106 are connected to each other by a film hinge 112. At its side 114 opposite the base plate, the intermediate plate 106 is connected by a further film hinge 116 to a cover plate 108. The base plate 104, the intermediate plate 106 and the cover plate 108 are collapsible in a zig-zag manner.

18 Claims, 3 Drawing Sheets

DEVICE FOR PRODUCING STREAKS IN HAIR

FIELD OF THE INVENTION

The invention concerns a hair-streaking device.

BACKGROUND OF THE INVENTION

It is known, when streaking hair, to lay a hair-"passee," using a stemmed comb or also by using a special streaking comb drawn from the parting of the hair, onto an aluminum foil and thereupon to dye this hair-"passee" with a brush to produce the streaks. The term "passee" is a French word used by hairdressers and means a plurality of or a strand of hair. Thereupon the foil with the treated hair is rolled up. This known method incurs several drawbacks: on account of its lack of rigidity, the aluminum foil cannot be made to lie accurately against the head as required to streak it from the roots on. Accordingly the streaks do not begin precisely at the roots. Dye application is laborious because of the pliant foil. Therefore two persons are needed for approximately accurate work.

OBJECTS AND SUMMARY OF THE INVENTION

The object of the present invention is to create a streaking device allowing one person to make streaks in many ways in an accurate and simple manner beginning at the roots.

This problem is solved by the embodiment of the invention shown in FIGS. 1 and 2. Namely, a base plate which can be set against a person's head and serve as a support for a hair "passee" to be treated. A perforation plate is provided that can be placed against the head and onto the base plate and, hence, onto the hair "passes". The perforation plate includes any desired arbitrary pattern and receives the streaking dye thereon and therethrough.

Further advantageous features of the embodiment of FIGS. 1 and 2 of the invention are stated in the specification and claims.

The invention proposes a streaking device in the form of a base plate and a perforation-pattern plate with a given pattern of holes, the hair-"passee" to be treated being laid between said plates, as rule an aluminum or plastic foil into which the treated hair shall be rolled being placed beforehand on the base plate. In order to be accurately placed against the head, the base plate and the perforated plate each comprise a rounded edge clearance approximately matching the head curvature. The device of the invention provides a flat, stable treatment support making possible simple and accurate treatment of the hair-"passee" by one person. The perforation-pattern plate can assume many designs and allows producing practically arbitrary streaks without the need for a streaking comb. Any desired pattern may be provided. The device of the invention allows treating not only the top hair, but also all other parts of it.

The device defined in regard to the embodiment of FIGS. 1 and 2 consists of several separate parts, as a result of which handling and operation of the device are still short of optimal.

In palliation, provision is made for the especially advantageous further embodiment of FIGS. 3–7, with the further features thereof. By means of these further features, all parts of the device are pivotably joined to each other, they are prevented from dropping and most importantly, they can be locked in place in the particular operational position. The hair-"passee" can be clamped between the base and intermediate plates and therefore the device automatically remains at the person's hair during dyeing. The cover plate protects the hair "passee" and covers it.

BRIEF DESCRIPTION OF THE DRAWINGS

The invention is elucidated below in relation to the attached drawing showing illustrative embodiments modes.

Identical components will be denoted by the same references in the Figures.

DETAILED DESCRIPTION OF THE INVENTION

Figure 1:
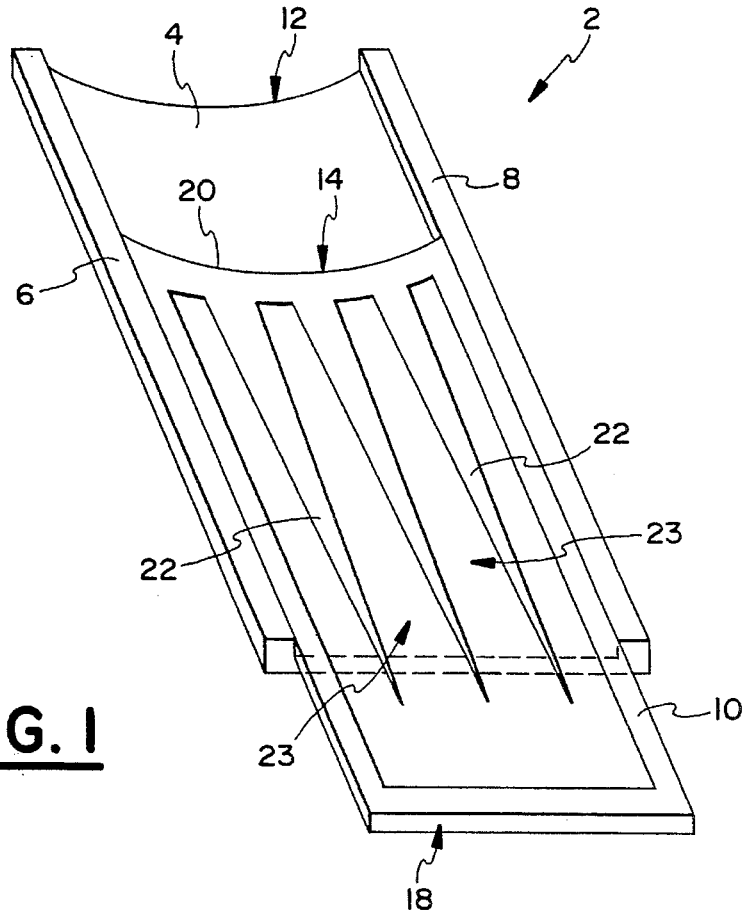
FIG. 1 is a perspective a first embodiment of a hair-streaking device.
Figure 2:
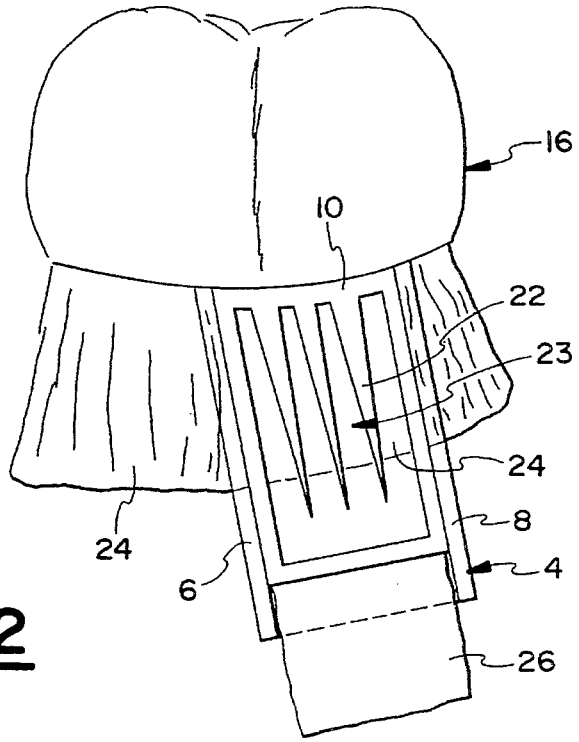
FIG. 2 schematically shows how to use the device of the invention to produce streaks.
Figure 3:
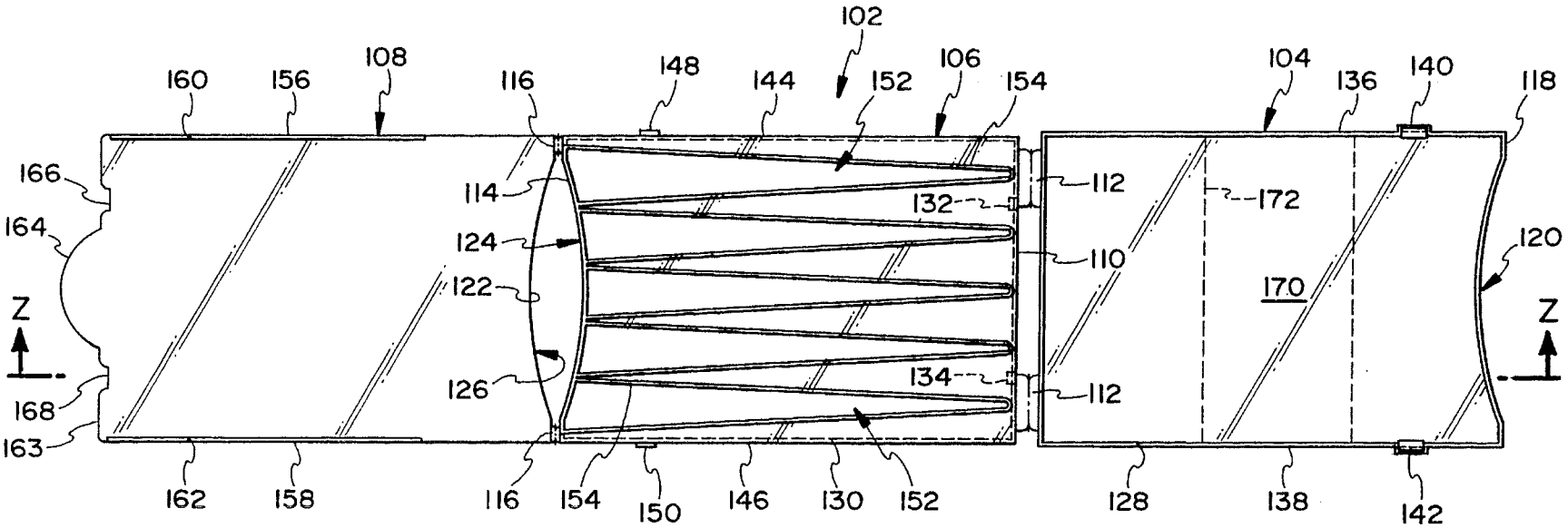
FIG. 3 is a second embodiment of a hair-streaking device shown in the opened position.

FIGS. 1 and 2 show a hair-streaking device 2. This device comprises a substantially rectangular base plate 4 with lateral guide rims 6, 8 for a substantially rectangular perforation-pattern plate 10.

The base plate 4 and the perforation-pattern plate 10 each comprise a concave side 12, 14 by which they can be placed against a person's head 16 (FIG. 2).

The preferred perforation-pattern plate 10 shown in FIGS. 1 and 2 consists of a rectangular frame 18 with a concave side 20 from which several mutually spaced, long tines 22 tapering into sharp tips point away in such manner that radially flaring zones 23 for dyeing hair streaks are gradually formed between the tines from the concave side 20 outward.

To streak the hair, a hair-"passee" 24 is deposited on an aluminum or plastic foil 26 laid on the base plate 4 deposited or directly on the base plate 4 (FIG. 2). Thereupon the perforation-pattern 10 is deposited on the hair-"passee" 24 and dye is deposited by a brush (omitted) on the perforation-pattern plate, as a result of which the hair is streak-dyed precisely in relation to the pattern of the perforated plate. After the dye has been deposited and if a foil is being used, the foil with the dyed hair is rolled up. Thereupon the next hair-"passee" can be treated correspondingly.

FIGS. 3 through 8 show the second embodiment a device 102 for making hair streaks and comprising an approximately rectangular base plate 104, an approximately rectangular intermediate plate 106 and an approximately rectangular cover plate 108, all preferably made of a transparent plastic.

The intermediate plate 106 is connected in articulating manner on one side by a film hinge or hinging tapes 112 to the base plate 104 and on the other side 114 by hinging tapes 116 to the cover plate 108. Base plate 104, intermediate plate 105, and cover plate 108 are collapsible together in a zig-zag manner.

At its free side 118, the base plate 104 comprises a first arcuate clearance 120 and the intermediate and cover plates 106 and 108 respectively comprise at their mutually connected sides 114 and 122 second and third arcuate clearances 124 and 126 between the laterally mounted hinging tapes 116, the clearances 124 and 126 being identical with the clearance 120 of the base plate 104 in such a way that the arcuate clearances 120, 124 and 126 will be superposed and aligned with each other when the device 102 is in its collapsed state.

The outside dimensions of the intermediate plate 106 and cover plate 108 are approximately the same, for instance being 80×118 mm. Preferably the base plate 104 is slightly larger and will be about 83×118 mm. The hinging tapes 112 between the base and intermediate plates may be 6 mm wide and the hinging tapes 116 between the intermediate and cover plate may be 2 mm wide.

The base plate 104 comprises a side flange 128 which points upward when the device 102 is unfolded and which is lower at the free side 118 of the base plate, or may be absent entirely, and the intermediate plate 106 comprises a downward-pointing peripheral flange 130 which is lower than the side flange 128. The width of the intermediate plate 106 is equal to or slightly less than the inside width between the side flanges of the base plate 104.

Figure 4:
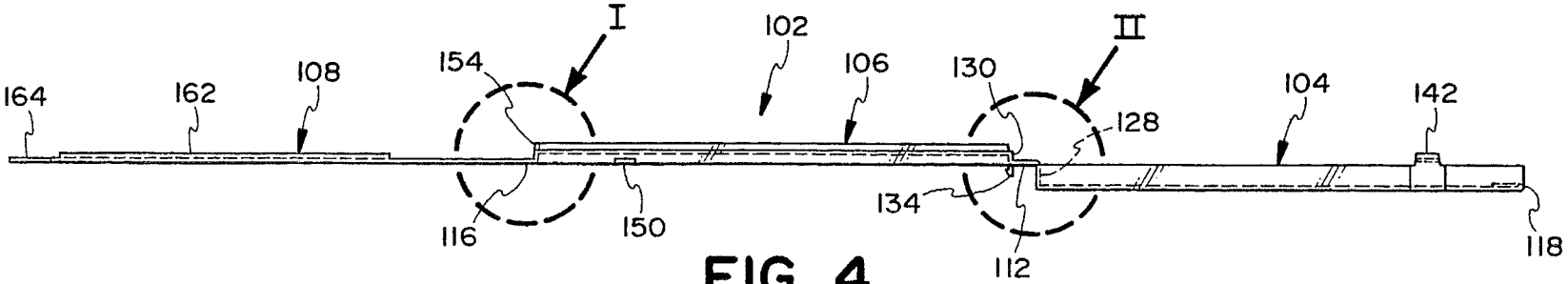
FIG. 4 is a sideview of the device of FIG. 3 in the open position.
Figure 5:
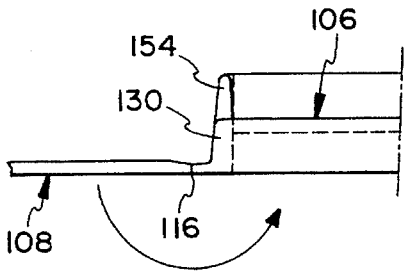
FIG. 5 is an enlarged view of the zone I of FIG. 4.
Figure 7:
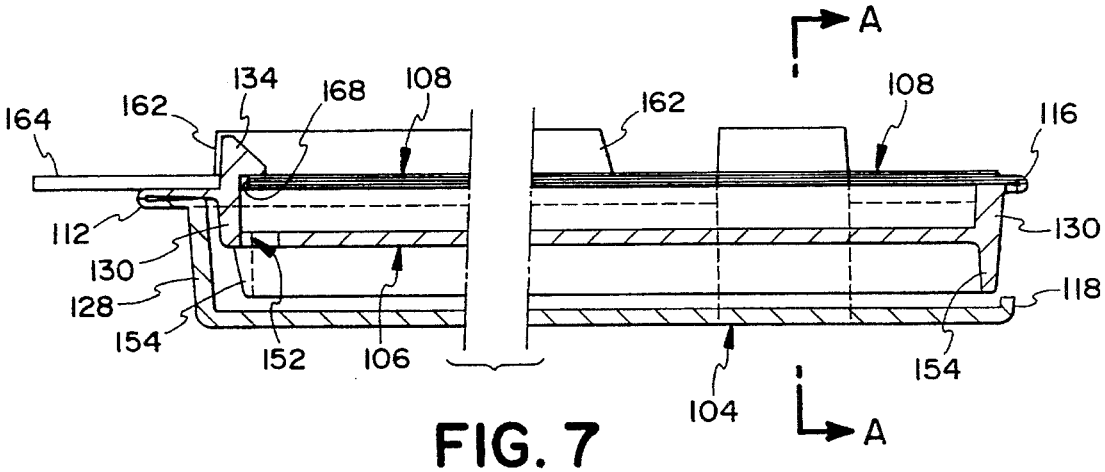
FIG. 7 is a section Z—Z of the device of FIG. 3 in the collapsed state.

The film hinges 112 connect the free ends of the flanges 128 and 130 to each other in such manner that when the device 102 is unfolded, the base and intermediate plates are located in offset planes as shown in particular in FIGS. 4 and 5, whereas in the collapsed state of the device 102, the intermediate plate 106 by its peripheral flange 130 internally overlaps the peripheral flange 128 of the base plate 104 in the manner clearly shown in FIG. 7.

Figure 6:
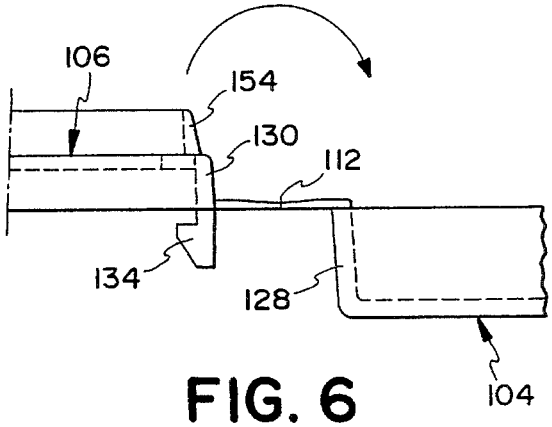
FIG. 6 is an enlarged view of the zone II of FIG. 4.

At its side 110 adjacent to the base plate 104 the intermediate plate 106 comprises two inward-pointing snap-in hooks 132 and 134 (FIGS. 4, 6, 7).

Figure 8:
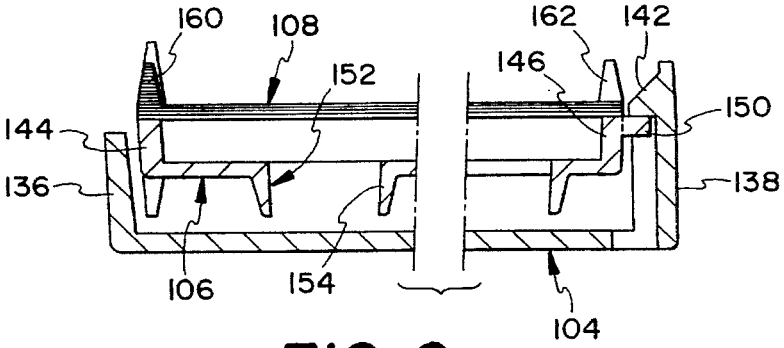
FIG. 8 is a section A—A through the device of FIG. 7.

At its two longitudinal sides 136 and 138 and in the vicinity of its free end the base plate 104 comprises an inward-pointing snap-in beak 140 and 142 respectively associated with snap-projections 148 and 150 mounted on the two longitudinal sides 144 and 146 of the intermediate plate 106, said snap-projections engaging the underside of the snap-in beaks 140 and 142 when the device 102 is collapsed (FIG. 8).

The intermediate plate 106 is fitted with several elongated, triangular holes 152 extending from the arcuate transverse side 114 to the opposite side 110 where they terminate by their apices. When the device 102 is unfolded, the holes 152 evince upwardly projecting peripheral flanges 154 of such a height that they terminate, in the folded state of the device 102, a distance in front of the base plate 104 (FIGS. 7, 8). The holes 152 need not assume the shown triangular shape, rather their geometry may be arbitrary.

The cover plate 108 comprises side flanges 160 and 162 at the longitudinal sides 156 and 158 projecting upwardly when the device 102 is unfolded and terminating a distance from the arcuate transverse side 122.

At its free end 163, the cover plate 108 comprises a central gripping bracket 164 and rectangular edge clearances 166 and 168 on both sides of said bracket 164, said clearances passing behind the snap-in hooks 132 and 134 when the device 102 is collapsed.

At its upper side 170 the base plate 104 preferably shall be fitted with a hook-and-loop fastener band 172 extending transversely across the base plate.

To produce streaks, the base plate is placed by its concave side 118 against the head of the person to be treated, whereupon a hair-"passee" is combed onto the base plate 104 or the velcro band 172 of this plate. The hook-and-loop fastener band 172 already provides good retention of the hair-"passee". Next the intermediate plate 106 is folded down onto the base plate 104, the snap-in beaks 140 and 142 gripping from behind the projections 148 and 150 and thereby connecting the two plates to each other. Thereupon the desired streak dye is deposited by brush onto the intermediate plate 106 and thus streak-dyeing of the hair shall be achieved in precise accordance with the perforation pattern of the intermediate plate. After the streak-dye has been brushed-on, the cover plate 108 is folded down and by its clearances 166 and 168 snaps in position behind the snap-in hooks 132 and 134 of the intermediate plate 106. Presently the base plate 104, the intermediate plate 106 and the cover plate 108 of the device 102 are mutually locked and may remain at the client's head until the end of streaking without requiring a special support, the hair-"passee" being clamped between the intermediate plate and the base plate. The dyeing process can be observed optically because the device 102 is made of a transparent plastic.

What is claimed is:

1. A device for hair streaking using a streaking dye, comprising:

a) a base plate, said base plate being configured for being placed against a user's head, and said base plate supporting a hair passee when in use;

b) an intermediate plate disposed adjacent said base plate, said intermediate plate being placeable against a user's head, and including a perforation pattern configured for receiving a streaking dye therethrough;

c) a film hinge disposed between and hingedly connecting said intermediate plate and said base plate;

d) a cover plate disposed adjacent said intermediate plate;

e) a further film hinge disposed between and hingedly connecting said cover plate and said intermediate plate; and, f) said base plate, said intermediate plate, and said cover plate being collapsible together in a zig-zag manner into a collapsed state.

2. A device as defined in claim 1, wherein:

a) a first arcuate clearance is defined in a side of said base plate;

b) a second arcuate clearance is defined in a side of said intermediate plate;

c) a third arcuate clearance is defined in a side of said cover plate; and, d) said first, second, and third, arcuate clearances are mutually substantially superposed when said base plate, said intermediate plate, and said cover plate are in said collapsed state.

3. A device as defined in claim 1, wherein:

a) said base plate and said intermediate plate include mutually associated snap-in elements, said snap-in elements being configured for detachably attaching said base plate and said intermediate plate when said base plate and said intermediate plate are in said collapsed state.

4. A device as defined in claim 3, wherein:

a) said snap-in element on said base plate is a snap-in beak; and, b) said snap-in element on said intermediate plate is a projection engageable with said snap-in beak.

5. A device as defined in claim 3, wherein:

a) said snap-in element on said intermediate plate is a snap-in hook; and, b) said cover plate includes a snap-in element configured for detachably attaching with said snap-in hook when said intermediate plate and said cover plate are in the collapsed state.

6. A device as defined in claim 1, wherein:

a) a side flange is provided on said base plate; and, b) a peripheral flange is provided on said intermediate plate, said peripheral flange being shorter than said side flange.

7. A device as defined in claim 6, wherein:

a) said side flange of said base plate defines an inside width between opposed portions of said side flange; and, b) said intermediate plate has a width substantially at most equal to said inside width.

8. A device as defined in claim 1, wherein:

a) said cover plate and said intermediate plate have substantially the same outside dimensions.

9. A device as defined in claim 1, wherein:

a) said cover plate includes a side flange extending around at least a portion of the perimeter thereof.

10. A device as defined in claim 1, wherein:

a) an outwardly projecting gripping bracket is provided on said cover plate.

11. A device as defined in claim 1, wherein:

a) a peripheral flange extends around at least a portion of the perimeter of said perforation pattern.

12. A device a defined in claim 1, wherein:

a) said base plate includes a free edge spaced from said film hinge;

b) said free edge includes an arcuate clearance defined therein; and, c) said free edge is substantially free of flanges.

13. A device as defined in claim 1, wherein:

a) a hook-and-loop fastener band is provided on said base plate.

14. A device as defined in claim 1, wherein:

a) said base plate, said intermediate plate, and said cover plate are substantially rectangular.

15. A device as defined in claim 1, wherein:

a) said base plate, said intermediate plate, and said cover plate are substantially concave.

16. A device as defined in claim 1, wherein:

a) said base plate, said intermediate plate, and said cover plate are made of plastic.

17. A device as defined in claim 1, wherein:

a) said perforation pattern includes a plurality of elongated, substantially triangular holes.

18. A device as defined in claim 1, wherein:

a) said further film hinge connecting said cover plate and said intermediate plate is spaced opposed from said film hinge connecting said intermediate plate and said base plate.

* * * * *